US007397330B2

(12) United States Patent
Kayano et al.

(10) Patent No.: US 7,397,330 B2
(45) Date of Patent: Jul. 8, 2008

(54) FILTER AND RADIO COMMUNICATION DEVICE USING THE SAME

(75) Inventors: Hiroyuki Kayano, Fujisawa (JP); Noritsugu Shiokawa, Yokohama (JP); Mutsuki Yamazaki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/555,129

(22) Filed: Oct. 31, 2006

(65) Prior Publication Data

US 2007/0069838 A1 Mar. 29, 2007

Related U.S. Application Data

(63) Continuation of application No. PCT/JP2006/316664, filed on Aug. 18, 2006.

(30) Foreign Application Priority Data

Sep. 29, 2005 (JP) ..... 2005-285325

(51) Int. Cl.
*H01P 1/203* (2006.01)

(52) U.S. Cl. ..... 333/204; 333/134

(58) Field of Classification Search ..... 333/203–205, 333/219, 134
See application file for complete search history.

(56) References Cited

U.S. PATENT DOCUMENTS 5,055,809 A * 10/1991 Sagawa et al. ..... 333/219
5,648,747 A 7/1997 Grothe et al.
6,026,311 A * 2/2000 Willemsen Cortes et al. ..... 333/219
6,381,478 B2 * 4/2002 Enokihara et al. ..... 505/210
2004/0233022 A1 11/2004 Tsuzuki et al.

FOREIGN PATENT DOCUMENTS

| | | |
|---|---|---|
| EP | 0 071 509 A1 | 2/1983 |
| EP | 0 741 430 A1 | 11/1996 |
| EP | 1 298 757 A1 | 4/2003 |
| EP | 1 329 977 A1 | 7/2003 |
| JP | 62-196402 | 12/1987 |
| JP | 63-204801 | 8/1988 |
| JP | 2000-307312 | 11/2000 |
| JP | 2002-76703 | 3/2002 |
| JP | 2003-46304 | 2/2003 |
| JP | 2003-234602 | 8/2003 |
| WO | WO 99/00897 | 1/1999 |

OTHER PUBLICATIONS

George L. Matthaei, et al Hairpin-Comb Filters for HTS and other Narrow-Band Applications, IEE Transactions on Microwave Theory and Techniques, vol. 45, No. 8, Aug. 1997.

* cited by examiner

*Primary Examiner*—Seungsook Ham
(74) *Attorney, Agent, or Firm*—Oblon, Spivak, McClelland, Maier & Neustadt, P.C.

(57) ABSTRACT

A filter includes a resonant unit which has a plurality of resonators respectively formed of each microstrip line and connected in cascade with one another, and a coupling unit which has at least one inter-resonator coupling of the resonant unit in an area within a range of ±45° (⅛-wavelength) in an electrical length from a voltage maximum point at a intermediate of the microstrip line.

15 Claims, 12 Drawing Sheets

FILTER AND RADIO COMMUNICATION DEVICE USING THE SAME

CROSS-REFERENCE TO RELATED APPLICATIONS

This is a Continuation Application of PCT Application No. PCT/JP2006/316664, filed Aug. 18, 2006, which was published under PCT Article 21(2) in English.

This application is based upon and claims the benefit of priority from prior Japanese Patent Application No. 2005-285325, filed Sep. 29, 2005, the entire contents of which are incorporated herein by reference.

BACKGROUND OF THE INVENTION

1. Field of the Invention

The present invention relates to a filter and a radio communication device using the same.

2. Description of the Related Art

In general, a filter to limit a frequency band for a radio communication system is structured by resonant units connected in cascade. Each resonator provided in the resonant unit includes an inductor and a capacitor and adds a resister for taking account of influence of a loss. A filter of such a type can determine a frequency range of a passband and a reduction amount of a blocking band by appropriately determining an inter-resonator coupling coefficient between resonators and determining a value of external Q to indicate an amount exciting the resonator in an input unit and an output unit.

On the other hand, Q (unloaded Q) to be determined by a dielectric loss, a conductor loss and a radiation loss of the resonator is an important parameter for realizing a filter property having a steep skirt property required by a band-pass filter, etc. The dielectric loss depends on a loss property of a dielectric substrate, the conductor loss depends on a loss property of a conductor and the radiation loss depends on a resonator layout. At a relatively low frequency dominated by the conductor loss, the influence of the radiation loss is small even when each resonator is coupled in any manner. In contrast, at a relatively high frequency dominated by the radiation loss, if the conductor is placed in the vicinity of a current maximum point of the resonator, the conductor becomes a dominant factor of radiation and finally, becomes a factor to deteriorate the filter property.

As for an example of a most general filter, a filter using a resonator formed of microstrip lines has been widely known. An electromagnetic wave propagating on the microstrip line propagates while reflecting repeatedly at open end portions thereof. Accordingly, in a half-wavelength resonator formed of a microstrip line of which the electric length is a half-wavelength (180°), a standing wave of a current distribution has nodes at both ends of the microstrip line and only one antinode at a center thereof.

A filter arranging half-wavelength hairpin resonators formed of hairpin-microstrip line in cascade so as to miniaturize its size is disclosed in G. L. Matthaei, et.al, "Hairpin Comb Filters for HTS and Other Narrow-Band Applications", IEEE MTT Trans., Vol. 45, No. 8, August 1997 (document 1).

On the other hand, a half-wavelength resonator using two straight lines and a microstrip line having an arc of a circle portion disposed between the straight lines and a filter using the resonator are disclosed in Jpn. Pat. Appln. KOKAI Publication No. 2003-46304 (document 2). The two linear lines are designed smaller than the width of the linear line in interval there between.

In each half-wavelength resonator, the center of a microstrip line of the resonator is the antinode of a current distribution, namely the current maximum point. Accordingly, in a filter in which a plurality of half-wavelength resonators arranged by shifting them by quarter-wavelength (90°), an end portion of a microstrip line of the next resonator is close to the current maximum point, so that the radiation at the maximum point becomes larger. According to the filter layout which is disclosed in the document 1 and in which the half-wavelength hairpin resonators are arranged in cascade, current maximum points that are folding portions of the microstrip lines of each resonator close to one another among the adjacent resonators. Therefore, radiations from the folding portions are increased. Like this, when the radiation losses of the resonators become large, it becomes hard to realize a filter property having a steep skirt property resulting from increases in Q values of the resonators.

On the other hand, relative magnitude correlation between the conductor loss and the radiation loss depends on a frequency of an electromagnetic wave propagating on the microstrip line. As mentioned above, in a low-frequency band, although the conductor loss is dominant, the relative magnitude correlation is inverted gradually as the frequency becomes higher, and in a high-frequency band, the radiation loss is apt to become dominant. Since the conductor loss is an energy loss caused from an electric resistance component of the conductor (conductor to form strip and ground plane) of the microstrip line, the conductor loss tends to become further dominant in accordance with an increase in its resistance component.

A resonator using a conventional microstrip line has a resonant frequency in a band of, for example, not higher than 3 GHz, and the conductor loss of which is dominant, because the resistance component of the conductor is relatively large. The conductor loss is reduced with relative ease by giving a uniform of a current density distribution in the microstrip line as much as possible. However, the intention of providing a resonator to be used in a band with a high-frequency higher than 3 GHz causes the radiation loss dominant. The resonator using the conventional microstrip line cannot decrease such a radiation loss, then, this fact that a high Q value cannot be achieved in the high-frequency band becomes a subject to be solved.

BRIEF SUMMARY OF THE INVENTION

An object of the present invention is to provide a filter for increasing Q of a resonator by reducing a radiation loss even in a high-frequency zone; and to provide a radio communication device using the same.

A filter regarding a first aspect of the present invention is characterized by comprising a resonant unit which has a plurality of resonators respectively formed of each microstrip line and connected in cascade with one another; and a coupling unit which has at least one inter-resonator coupling of the resonant unit in an area within a range of ±45° (⅛-wavelength) in an electric length from a voltage maximum point at a intermediate of the microstrip line.

A filter regarding a second aspect of the present invention is characterized by comprising an input line which receives an input signal; an output line which outputs an output signal; a resonant unit which has a plurality of resonators to be respectively formed of each microstrip line including a first resonator coupled to the input line, a second resonator connected to the output line and a plurality of third resonators positioned at intermediates between the first resonator and the second resonator and to be connected in cascade with one another; a first coupling unit which has a coupling between the input line and the first resonator in a first area within a range of ±45° in an electric length from a voltage maximum point at an intermediate of the microstrip line of the first resonator; a second coupling unit which have a coupling between the second resonator and the output line in a second area within a range of ±45° in electric lengths from a voltage maximum point at an intermediate of the microstrip line of the second resonator; and at least two third coupling units which have inter-resonator couplings of the third resonators in third areas within ranges of ±45° in electric lengths from voltage maximum points at intermediates of the microstrip lines of the third resonators.

A filter regarding a third aspect of the present invention is characterized by comprising a dielectric substrate; a first line and a second line which are arranged in nearly parallel with each other on the dielectric substrate and respectively have a first open end portion and a second open end portion adjacent to each other; and a third line which is arranged on the dielectric substrate and connects between a third end portion and a fourth end portion which are the opposite end to the first open end portion of the first line and the opposite end to the second open end portion of the second line respectively, in which each width of the first line and the second line is equal to each other, a distance between the first line and the second line is narrower than the line widths thereof and a total electrical length of the first, second and third lines is an odd number, three or more, multiple of 180°.

A filter regarding a fourth aspect of the present invention is characterized by comprising a resonant unit which includes a plurality of the resonators described in claim 12 and connected in cascade with one another; an input line which is arranged on the dielectric substrate and receives an input signal to supply it to the resonant unit; and an output line which is arranged on the dielectric substrate and outputs an output signal inputted from the resonant unit.

A radio communication device regarding a fifth aspect of the present invention is characterized by comprising a power amplifier which amplifies a radio frequency signal; a filter described in claim 1 which receives an output signal from the power amplifier to limit a band; and an antenna which receives the output signal from the filter to transmit it.

A radio communication device regarding a sixth aspect of the present invention is characterized by comprising an antenna which receives a radio frequency signal; a filter described in claim 1 which receives an output signal from the antenna to limit a band; and a low-noise amplifier which receives an output signal from the filter to amplify it.

DETAILED DESCRIPTION OF THE INVENTION

Hereinafter, embodiments of the present invention will be described with reference to the drawings.

Figure 1A:
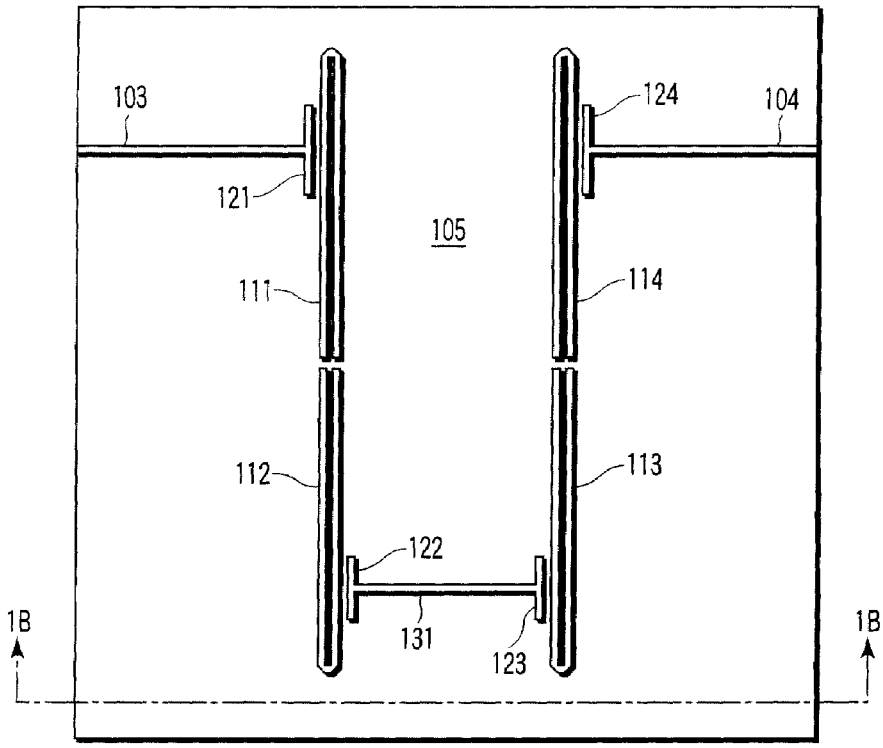
FIGS. 1A and 1B are a plane view of a filter regarding a first embodiment of the present invention and a cross-sectional view taken on line 1B-1B, respectively.
Figure 1B:
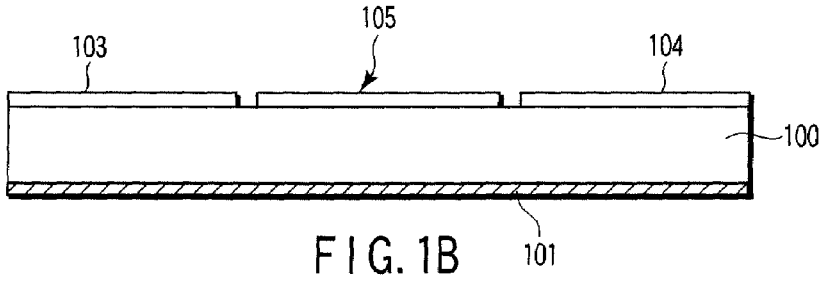

FIGS. 1A and 1B show the plane view and the cross-sectional view taken on line 1B-1B of the filter regarding the first embodiment of the present invention, respectively. A ground plane 101 is formed on a rear surface of a dielectric substrate 100 and an input line 103, an output line (also called exciting line) 104 and a resonant unit 105 are formed on a front surface of the dielectric substrate 100. Each one end of the input line 103 and output line 104 extend up to end portions of the dielectric substrate 100 to get connected with a circuit placed outside the filter at the end portions of the dielectric substrate 100, respectively.

The dielectric substrate 100 is made of material, such as a magnesium oxide and a sapphire with thickness of around 0.1 to 1 mm. The ground plane 101, input line 103, output line 104 and resonant unit 105 are made of conductor material, for example, a metal such as copper, silver and gold, a superconductor such as niobium or niobium tin, or an oxide superconductor such as YBCO.

Like this, a structure to form the ground plane 101 on the rear surface of the dielectric substrate 100 and form a conductor pattern on the surface of the dielectric substrate 100 is called a microstrip line structure. Hereinafter, the conductor pattern itself formed on the surface of the dielectric substrate 100 is referred to as the microstrip line.

The resonant unit 105 includes four stages of microstrip line type resonators 111-114 connected in cascade between the input line 103 and output line 104. Each resonator 111-114 is formed of the microstrip line having an electric length of a one-wavelength or more, for example, 1.5-wavelength. Each microstrip line has U shape (generally called hairpin type) line, respectively. A resonator using the microstrip line with such a shape is called a hairpin resonator.

Adjacent resonators on the same line, for example, a first stage resonator 111 and a second stage resonator 112 are disposed so that open end portions of each microstrip line come close to and opposite to each other. Similarly, adjacent resonators on another same line, for example, a third stage resonator 113 and a fourth stage resonator 114 are disposed so that the open end portions of each microstrip line come close to and opposite to each other. Like this manner, clearance gaps between the resonators 111 and 112 and the resonators 113 and 114 which are adjacent resonators on the same lines, respectively, are coupled by approaching and facing the open end portions of the microstrip lines each other.

The resonators 111-114 provided with coupling areas within ranges of ±45° (⅛-wavelength) in electric lengths from voltage maximum points at intermediates of each microstrip line, respectively. A coupling element 121 is placed close to the left side in FIG. 1A in a coupling area of the first stage resonator 111 and the input line 103 is connected with the coupling element 121. Similarly, a coupling element 122 is placed close to the right side in FIG. 1A in a coupling area of the second stage resonator 112, further, a coupling element 123 is placed close to the left side in FIG. 1A in a coupling area of the third stage resonator 113 and the coupling elements 122 and 123 are connected by a connection line 131.

The connection line 131, like the input line 103 and output line 104, extends toward directions perpendicular to propagation directions of electromagnetic waves in the resonators. A coupling element 124 is placed close to the right side in FIG. 1A in a coupling area of the fourth resonator 114 and the output line 104 is connected with the coupling element 124.

Like this manner, in the aforementioned coupling areas, the coupling elements 121-124 couple the resonant unit 105 to the input line 103 and the output line 104, and couple the resonators 111 and 114 adjacent by facing the side surfaces each other. The connection line 131 couples the resonators 112 and 113.

Figure 2:
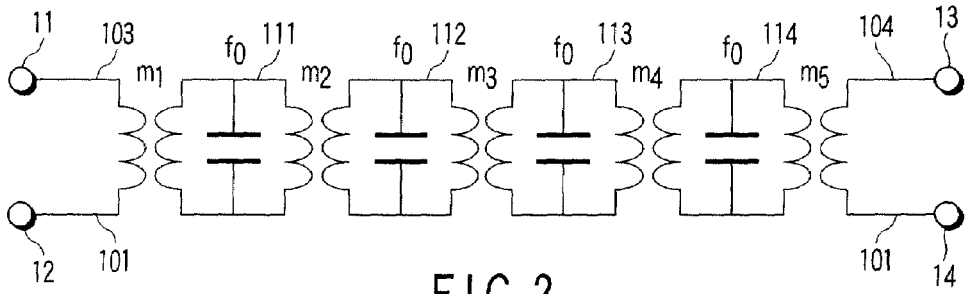
FIG. 2 is a view showing an equivalent circuit of the filter shown in FIGS. 1A and 1B.

Operations of the filters shown in FIGS. 1A and 1B will be described. FIG. 2 shows the equivalent circuit of the filters shown in FIGS. 1A and 1B. In FIG. 2, an input terminal 11 gets connected to the input line 103 and a ground terminal 12 gets connected to the ground plane 101. An input signal supplied between the input terminal 11 and the ground terminal 12 passes the resonators 111-114 sequentially then it is taken out in an interval between the output terminal 13 and the ground terminal 14. The output terminal 13 creates a connection with the output line 104 and the ground terminal 14 creates a connection with the ground plane 101.

Each of the resonators 111-114 are equivalently represented by inductors and capacitors, respectively. In the case of considering the influence of the loss, resisters are also added to the resonators 111-114, respectively. Each resonant frequency of the resonators 111-114 in the case of no resisters are represented by the following formula.

$$F_0=1/\mathrm{sqrt}(L\times C) \tag{1}$$

Here, $f_0$ is a resonant frequency, sqrt is a square root, L is an inductance and C is a capacitance.

The filter can determine a passband and a reduction amount of a blocking band by appropriately determining a coupling coefficient ml of external Q by watching the side of the first stage resonator 111 from the input terminal 11; a coupling coefficient m5 of external Q by watching the side of the fourth stage resonator 114 from the output terminal 13; and inter-resonator coupling coefficients m2, m3 and m4 indicating coupling between resonators 111-114. Unloaded Q, namely Qu of the resonator using the above-described microstrip line is determined by a dielectric loss Qd, a conductor loss Qc and a radiation loss Qr, and these losses become important parameters for realizing a steep skirt property of a filter property. The relations among these losses are expressed by the following formula.

$$1/Qu=1/Qd+1/Qc+1/Qr \tag{2}$$

Figure 3:
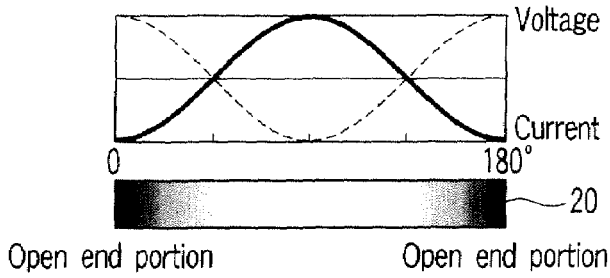
FIG. 3 is a view showing a voltage distribution and a current distribution in a half-wavelength resonator.
Figure 4:
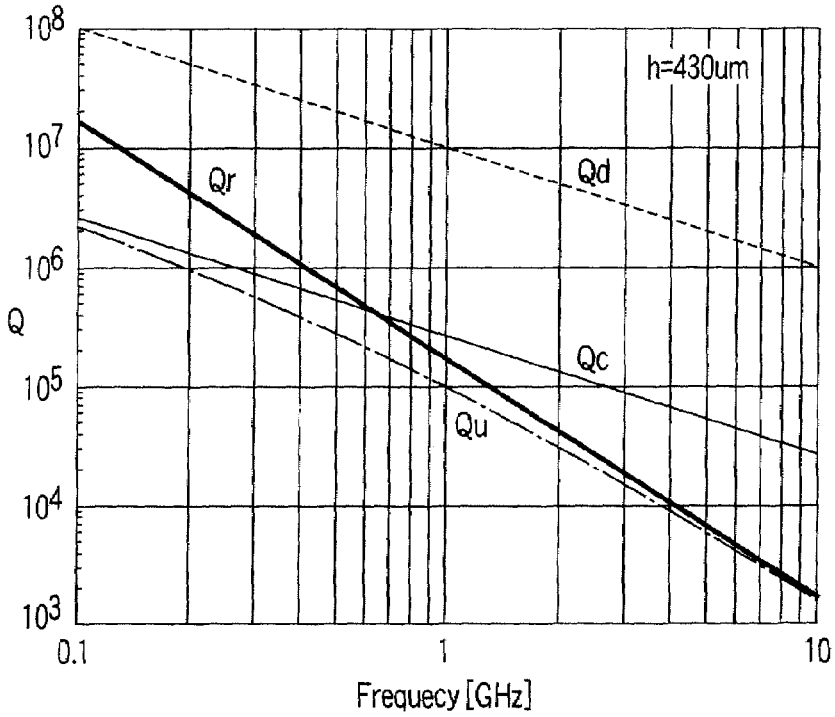
FIG. 4 is a view showing an example of a calculation result of an dielectric loss Qd, a conductor loss Qc and a radiation loss Qr in relation to a straight microstrip line type resonator which is arranged in cascade by sifting four pieces of half-wavelength resonators by quarter-wavelength on a dielectric substrate.

FIG. 3 shows voltage and current distributions of a half-wavelength resonator 20 used usually and widely. As shown in FIG. 3, the half-wavelength resonator 20 has its voltage maximum points only at open end portions of the resonator 20. FIG. 4 shows examples of calculation results of the dielectric loss Qd, conductor loss Qc and radiation loss Qr relating to a straight half-wavelength microstrip line type resonator on the dielectric substrate with a thickness of 430 μm and a dielectric constant of 10. In a relatively low-frequency band dominated by the conductor loss Qc, a coupling of each resonator in any manner causes small influence by the radiation loss Qr.

In contrast, in the relatively high-frequency band dominated by the radiation loss Qr, if a conductor is present in the vicinity of the current maximum point of the resonator, the conductor causes power radiation extremely to deteriorate the filter property. The half-wavelength resonator using the microstrip line has its current maximum point at the center in its length direction. Accordingly, in a microstrip line type resonator in which four pieces of half-wavelength resonators are arranged in cascade by sifting them by quarter-wavelength, since a current maximum point of a certain resonator among the half-wavelength resonators and an open end portions of other resonators adjacent thereto are close to each other, radiation of power increases. This problem is similarly caused by the filter disclosed in the document 1.

Figure 5:
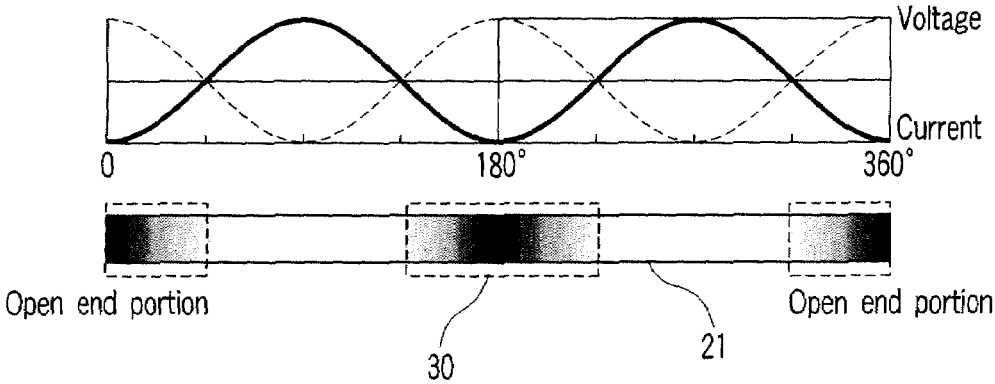
FIG. 5 is a view showing a voltage distribution and a current distribution in a one-wavelength resonator.
Figure 6:
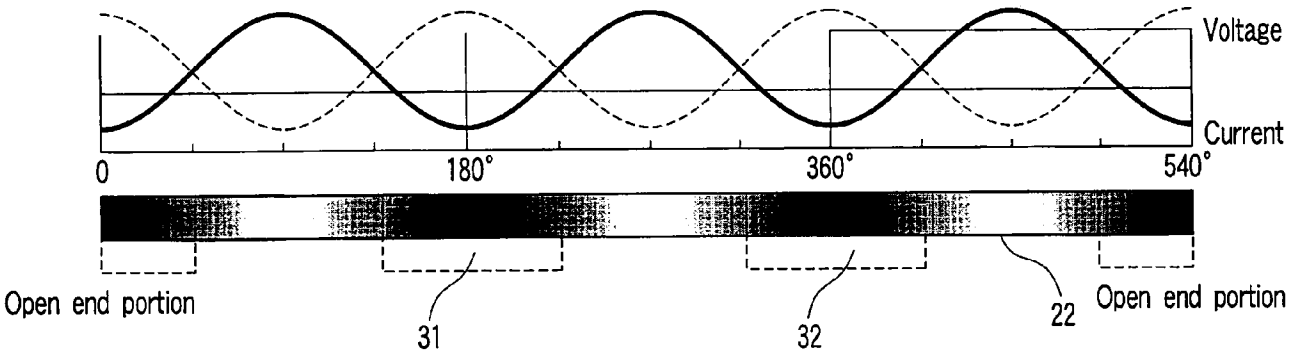
FIG. 6 is a view showing a voltage distribution and a current distribution in 1.5-wavelength resonator.

FIGS. 5 and 6 show a voltage distribution and a current distribution of a one-wavelength resonator 21 and a 1.5-wavelength resonator 22, respectively. As shown in FIGS. 5 and 6, a resonator of an electric length of one or more-wavelength can have a voltage maximum point at an intermediate portion of the microstrip line, that is, positions other than the open end portions. A reason of an increase in radiated power comes from radiation of power generated by disturbance owing to conductors placed next to each other, although in a current distribution of an electromagnetic filed distribution on a microstrip line originally having no power to be radiated. In other words, in the case where adjacent conductors are placed on the microstrip line, the radiation of power can be restricted by placing the conductors at the positions in which the conductors do not disturb the current distribution on the microstrip line.

A method of preventing from disturbance of the current distribution can be achieved by approximating the adjacent conductors (not shown) within ranges of ±45° (⅛-wavelength) from the voltage maximum points (points at which voltage become further dominant than current) of the resonator, namely ranges shown by broken lines 30-32 in FIG. 5 and FIG. 6. The one-wavelength resonator 21 shown in FIG. 5 has a voltage maximum point at the center portion indicated by the broken line 30 other than the open end portions of the microstrip line. And the 1.5-wavelength resonator 22 shown in FIG. 6 has voltage maximum points at two positions indicated by the broken lines 31 and 32 other than the open end portions of the microstrip line.

The hairpin resonators 111-114 having the electric lengths of which are 1.5-wavelengths shown in FIG. 1A and FIG. 1B have four positions of voltage maximum points in addition to the open end portions, respectively. That is, the open end portions can realize three positions capable of obtaining couplings per one resonator so as to approximate the conductors.

In FIG. 1A and FIG. 1B, coupling methods for approximating to face open end portion of the microstrip line each other is used to couple between the adjacent first and second resonators 111 and 112 and between the adjacent third and fourth resonators 113 and 114 for miniaturizing them.

The coupling areas (areas indicated by broken lines 31 and 32 in FIG. 6) that are ranges within ±45° for the voltage maximum points other than the open end portions achieve couplings between the input line 103 and the first resonator 111, between the adjacent second third resonators 112 and 113 and between the fourth resonator 114 and the output line 104. For the couplings in these coupling areas, the filter approximates T-shape lines to the microstrip lines of each resonator 111-114. The input line 103, output line 104 and connection line 131 extending toward directions perpendicular to propagation directions of electromagnetic waves in the resonators are arranged. Further, the coupling elements 121-124 forming T-shape lines together with the input line 103, output line 104 and connection line 131 are arranged.

Like this manner, by crossing the electromagnetic wave propagation directions on the resonators 111-114 and those on the input line 103, output line 104 and connection line 131 at right angles one another, direct couplings among the resonators 111-114 and the input line 103, output line 104 and connection line 131 become minimum. On the other hand, it is preferable for the coupling elements 121-124 to have electric lengths not less than widths of the input line 103, output line 104 and connection line 131 and also less than 90° (quarter-wavelength) to obtain effective couplings.

The filter can adjust necessary coupling strengths by adjusting the distance among the coupling elements 121-124 and the resonators 111-114 and/or the lengths of the coupling elements 121-124. To make the necessary coupling strengths among the coupling elements 121-124 and the resonators 111-114 be completely equal to one another, it is necessary to make the coupling elements 121-124 be the same in shape. Actually, a usual filter frequently makes coupling coefficients differ (that is, making coupling coefficients m1, m2, m3, m4 and m5 in FIG. 2 differ). In such a case, the usual filter makes coupling elements 121-124 differ in shape.

Figure 7:
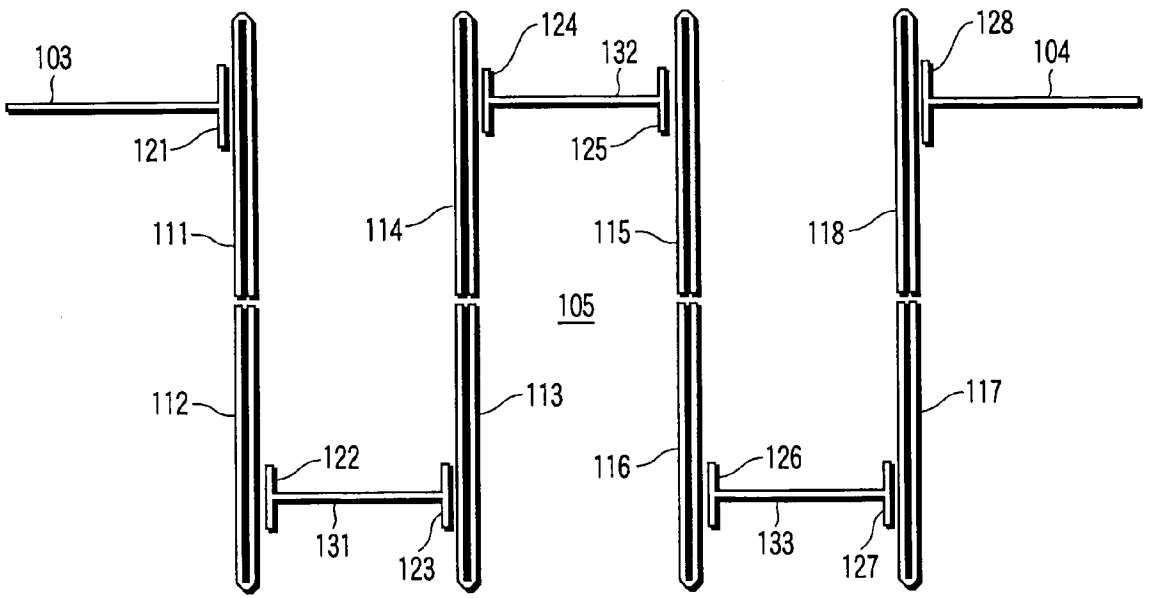
FIG. 7 is a plane view of a filter regarding another embodiment of the present invention.

FIG. 7 shows a filter regarding a second embodiment of the present invention and it expands structures of the filter in FIGS. 1A and 1B to get connected in cascade with eight pieces of hairpin resonators 111-118 each having lengths of 1.5-wavelength. Like the first embodiment, the couplings between the adjacent resonators on the same straight line, in other words, the couplings between the resonators 111 and 112, between the resonators 113 and 114, between the resonators 115 and 116 and between the resonators 117 and 118 are respectively achieved by approximating and facing the open end portions of the microstrip lines each other.

On the other hand, the couplings between the input line 103 and the first stage resonator 111, between the second stage resonator 112 and third stage resonator 113, between the fourth stage resonator 114 and fifth stage resonator 115 and between the sixth stage resonator 116 and the seventh stage resonator 117 are respectively achieved by using the coupling elements 121-128 and connection lines 131-133 disposed close to the coupling areas within the ranges of ±45° from the voltage maximum points of intermediates of the microsprit lines.

Figure 8:
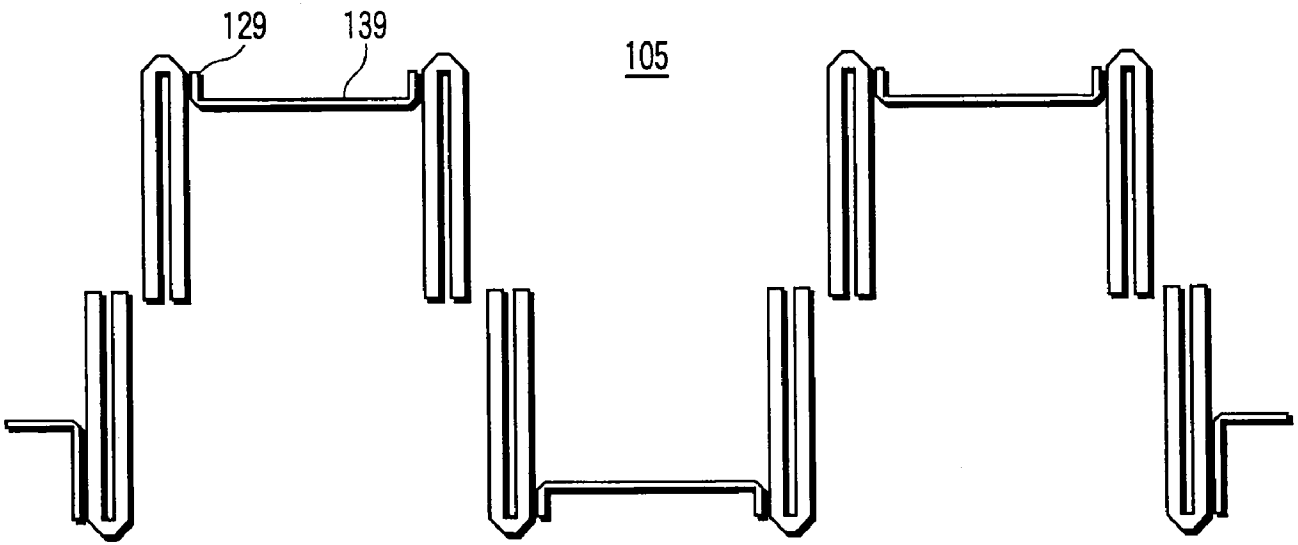
FIG. 8 is a plane view of a filter regarding a compared example.

FIG. 8 shows the filter of the compared example. In like manner in FIG. 7, the filter utilizes eight pieces of hairpin resonators respectively having electric lengths of 1.5-wavelength. Each hairpin resonator with 1.5-wavelength has the current maximum point at a folding portion of a microstrip line. In the compared example in FIG. 8, a coupling element 129 is disposed in the vicinity of such a current maximum point further coupling elements are connected with each other by a connection line 139.

Figure 9:
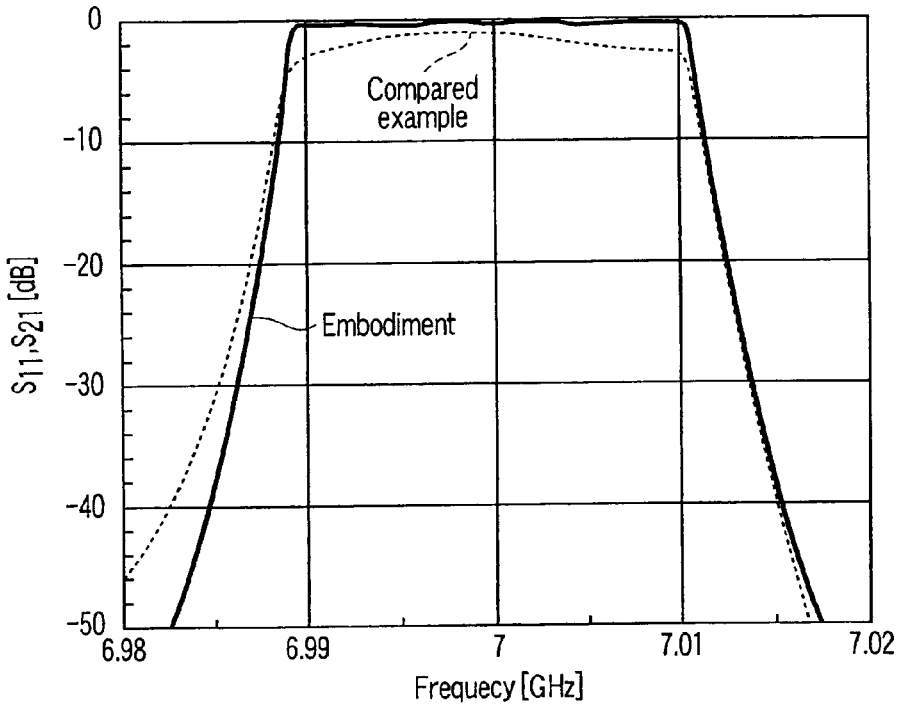
FIG. 9 is a view showing frequency response properties obtained by electromagnetic analyses of the filters in FIG. 5 and FIG. 7.

FIG. 9 shows the frequency response property obtained by the electromagnetic field analyses of the filters in FIG. 7 and FIG. 8. The horizontal and vertical axes in FIG. 9 indicate frequencies and S parameters $S_{11}$ and $S_{21}$, respectively. In the analyses, it is assumed that the conductor loss and dielectric loss are '0' so that the analyses view only effect of a radiation property. The filter layout in the compared example shown in FIG. 8 deteriorates the Q of the resonator because radiation is generated by the coupling element 129 placed at the voltage maximum point. This deterioration of the Q increases the loss at end portions in the passband and deteriorates a property of frequency selectivity and an insertion loss property, as shown by a broken line in FIG. 9. In contrast, the filter layout in FIG. 7 based on the second embodiment of the present invention, since the coupling elements 121-128 are placed within the ranges of ±45° from the voltage maximum points, the influence of unnecessary radiation is small. Accordingly, an ideal property for a filter is obtained, as shown by a solid line in FIG. 9.

Figure 10:
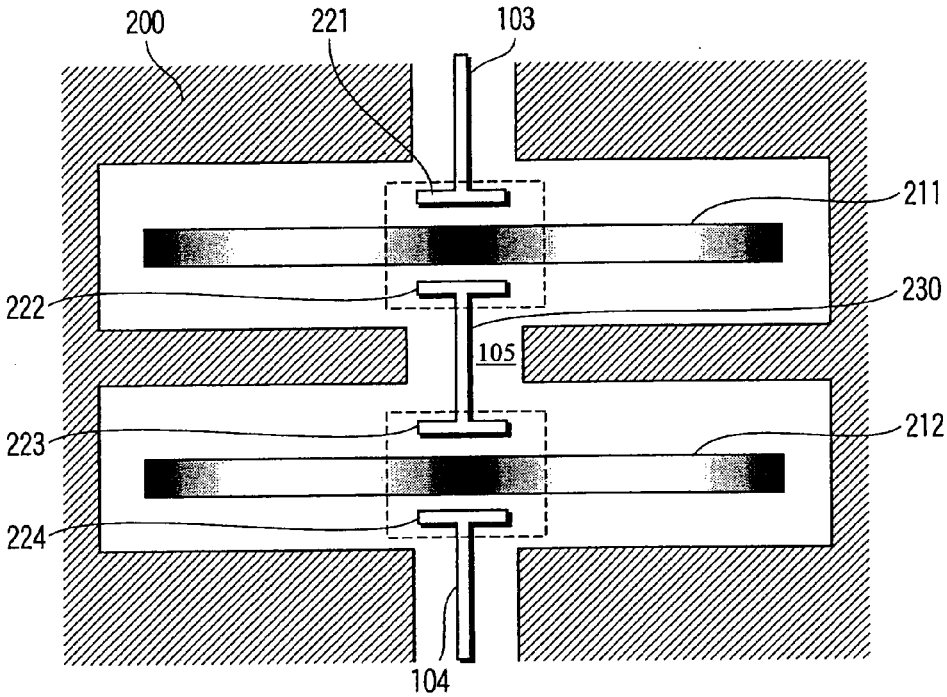
FIG. 10 is a plane view of a filter regarding other embodiment of the present invention.

FIG. 10 shows the plane view of the filter regarding other embodiment of the present invention. The input line 103, the output line 104 and the resonant unit 105 are formed on the dielectric substrate (not shown). The resonant unit 105 includes two microstrip line resonators 211 and 212 formed of straight microstrip lines each having the electric length of one-wavelength. The resonators 211 and 212 get connected in cascade between the input line 103 and output line 104. To avoid unnecessary radiation as much as possible, the second embodiment further performs electromagnetic shielding by means of a conductor film 200 formed on the dielectric substrate so as to surround the resonant unit 105.

Since the electric lengths of both resonators 211 and 212 are one-wavelength, both resonators 211 and 212 have voltage maximum points at both open end portions and central portions in length directions, respectively. Therefore, like the first and second embodiments, the coupling areas are defined within the ranges (shown in broken line) of ±45° from the voltage maximum points at the center portions. In the coupling areas, the filter achieves the couplings between the input line 103 and the first stage resonator 211, between the resonators 211 and 212 and between the second stage resonator 212 and the output line 104. For achieving such couplings, the filter disposes a connection line 230 between the resonators 211 and 212 and also disposes coupling elements 221-224 forming a T-shape line together with the input line 103, output line 104 and the connection lime 230.

Like this arrangement, the filter can also achieve the couplings between the input line 103 and the first stage resonator 211, between the resonators 211 and 212 and between the second stage resonator 212 and the output line 104 by using only the coupling areas within the ranges of ±45° from the voltage maximum points at intermediate portions of the microstrip lines of the resonators without using the couplings of the open end portions of the microstrip lines. According to such a filter, a strong coupling in the whole of the couplings can be realized in comparison with the case of use of the couplings at the open end portions. Accordingly, this embodiment is effective to provide a wide band filter to be required the strong coupling.

Figure 11:
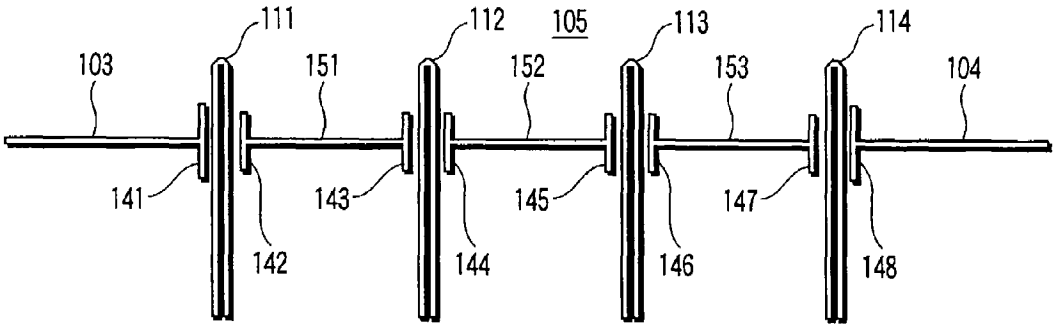
FIG. 11 is a plane view of a filter regarding other embodiment of the present invention.

FIG. 11 shows other embodiment of the present invention, which expands the filter shown in FIG. 10 to a filter having four pieces of hairpin resonators 111-114 each having electric lengths of 1.5-wavelength. The filter in this embodiment utilizes only the coupling areas within ranges of ±45° from the voltage maximum points at intermediate portions of the microstrip lines for the whole of the couplings, that is, the couplings between the input line 103 and the first stage resonator 111, between the adjacent resonators, namely resonators 111 and 112, between the resonator 112 and 113, between the resonators 113 and 114 and between the resonator 114 and the output line 104. The couplings in such coupling areas are performed by the coupling elements 141-148 and connection lines 151-153.

Figure 12:
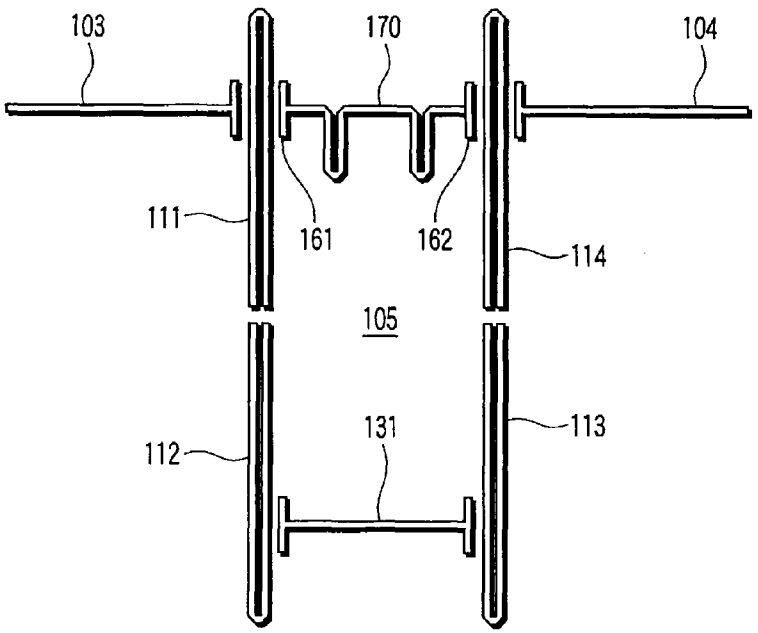
FIG. 12 is a plane view of a filter regarding other embodiment of the present invention.

FIG. 12 shows an embodiment for adding a cross coupling to the filters in the embodiments shown in FIG. 1A and FIG. 1B. The cross coupling is, as already known, a coupling between resonators other than adjacent resonators, in a resonant unit having a plurality of resonators connected in cascade. In FIG. 12, the embodiment adopts the jump coupling between the first stage resonator 111 and the fourth stage resonator 114. Cross couplings between resonators 111 and 114 are performed by using the coupling elements 161 and 162 disposed in the coupling areas within the ranges of ±45° from the voltage maximum points at intermediate portions of each microstrip line of the resonators 111 and 114 and a connection line 170 connecting between coupling elements 161 and 162.

Figure 13:
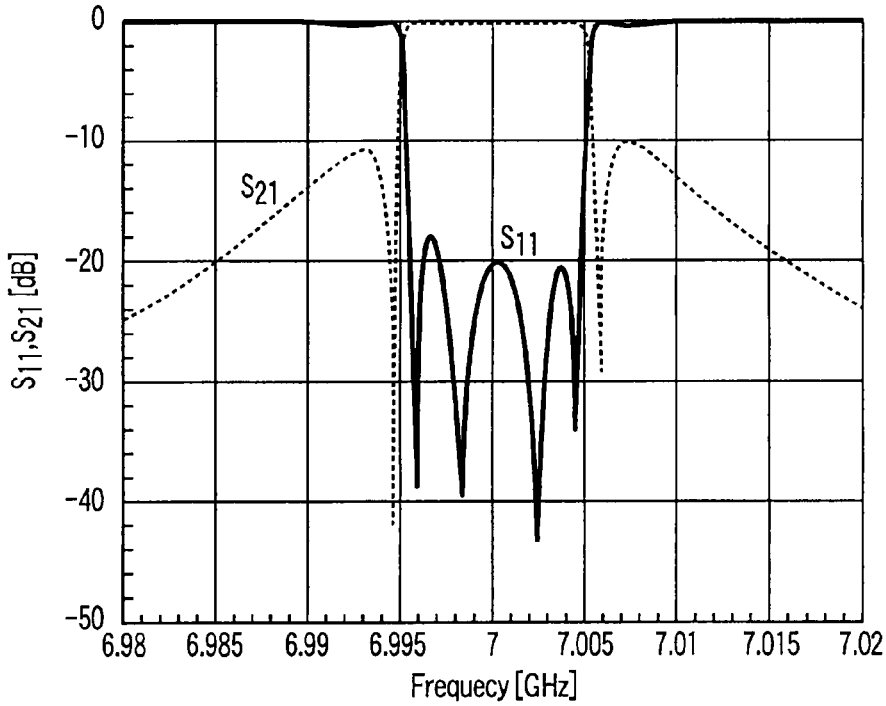
FIG. 13 is a view showing a frequency response of the filter in FIG. 12.

FIG. 13 shows the response property of the filter in FIG. 12. As shown in FIG. 13, by using the cross coupling like shown in FIG. 12, the filter can make zero points (dip) on both sides in a desired frequency band, thereby, can achieve a steep skirt property.

Figure 14:
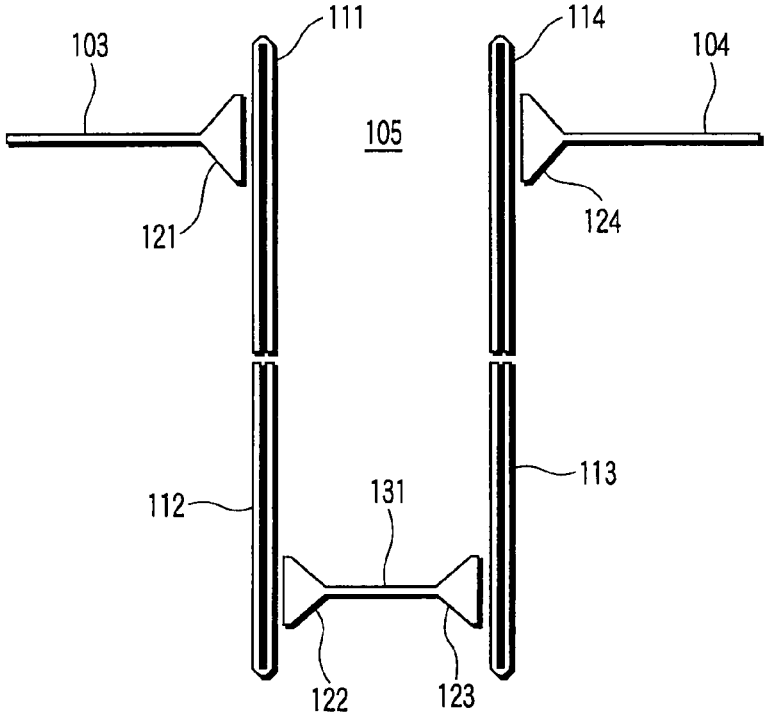
FIG. 14 is a plane view of a filter regarding other embodiment of the present invention.

FIG. 14 shows an embodiment modifying the filters in FIGS. 1A and 1B, and coupling elements 121-124 have shapes larger than those of FIGS. 1A and 1B, for example, shapes of inverted triangles. Thereby, coupling strengths can be increased. Therefore, the structure in FIG. 14 is effective to achieve a wide band filter. Such a modified structure shown in FIG. 14 is applicable to the embodiments in FIG. 7, FIG. 11 and FIG. 12.

Figure 15:
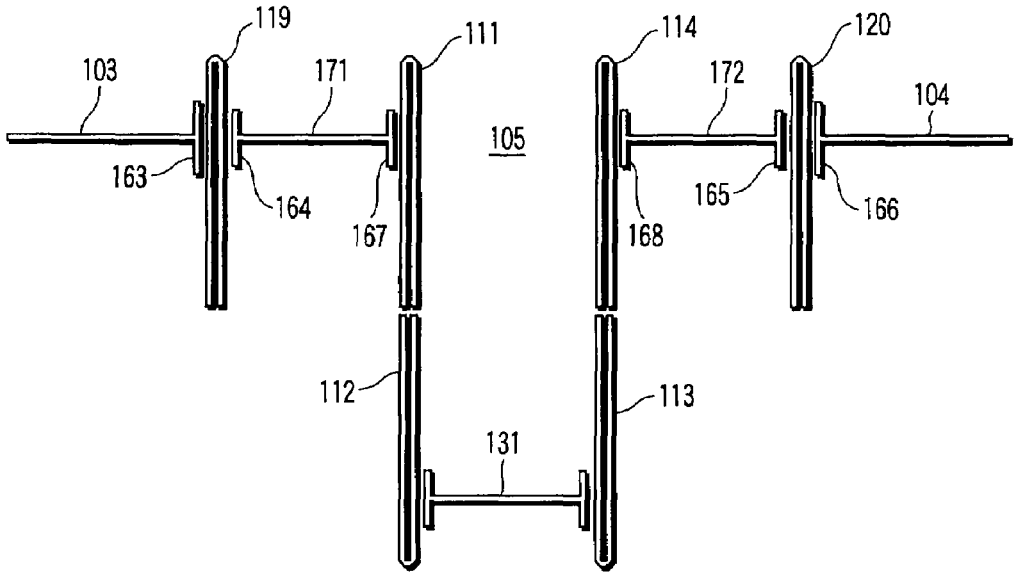
FIG. 15 is a plane view of a filter regarding other embodiment of the present invention.

FIG. 15 further different embodiment in which the filters in FIGS. 1A and 1B are modified. The filter in FIG. 15 inserts hairpin resonators 119 and 120 with electric lengths of 1.5-wavelength between the input line 103 and the resonator 111 and between the resonator 114 and the output line 104 in the FIGS. 1A and 1B.

Couplings between the input line 103 and added hairpin resonator 119, between the resonator 119 and the resonator 111, between the resonator 114 and added resonator 120 and between the resonator 120 and the output line 104 go the same as those of aforementioned embodiments. That is, these couplings are conducted by using coupling elements 163-168 arranged within ranges of ±45° from the voltage maximum points at the intermediate portions of each microstrip line of the resonators 119 and 120, a connection line 171 connecting between coupling elements 164 and 167 and a connection line connecting between coupling elements 165 and 168.

A filter layout in FIG. 15 forms a rough shape of the whole of the filter in a half circle, then, it becomes possible for the filter to effectively use, for example, a half area on a circle-like dielectric substrate.

Other embodiment regarding the present invention relating to a resonator will be described below. The following resonator can be utilized as a component of a filter in which a plurality of resonators is connected in cascade, which has been described in the aforementioned embodiments. And the resonator can be also usable as a single body of a resonator or a filter composed of a single resonator.

Figure 16A:
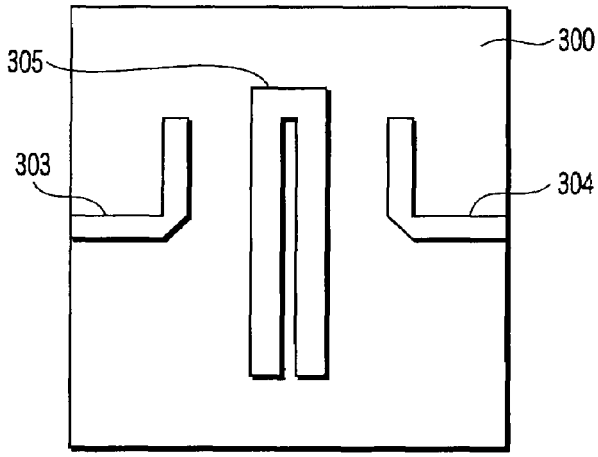
FIGS. 16A and 16B are plane view and a cross-sectional view of a resonator regarding other embodiment of the present invention, respectively.
Figure 16B:
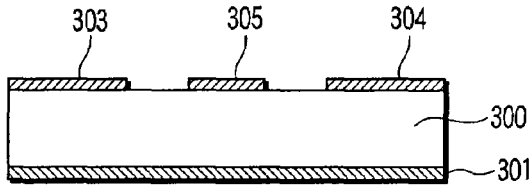

FIGS. 16A and 16B show a plane view and a cross-sectional view schematically showing the resonators regarding other embodiment of the present invention. As described in the forgoing embodiments, the resonator of this embodiment is also a hairpin resonator. A ground plane 301 is formed on a rear surface of a dielectric substrate 300 and an input line 303, an output line 304 and a resonator pattern 305 are formed on a front surface of the dielectric substrate 300. As for a material of the dielectric substrate 300, a material, for example, a magnesium oxide, sapphire of about 0.1 mm to 1 mm thick and the like is employed. The ground plane 301, input line 303, output line 304 and resonator pattern 305 are made of the conductor materials, for example, metals such as copper, silver and gold, superconductors such as niobium or niobium tin, or oxide superconductors such as YBCO. A structure forming the ground plane 301 on the rear surface of the dielectric substrate 300 and forming the conductor pattern on the front surface thereof in the manner mentioned above is called a microstrip structure.

Figure 17:
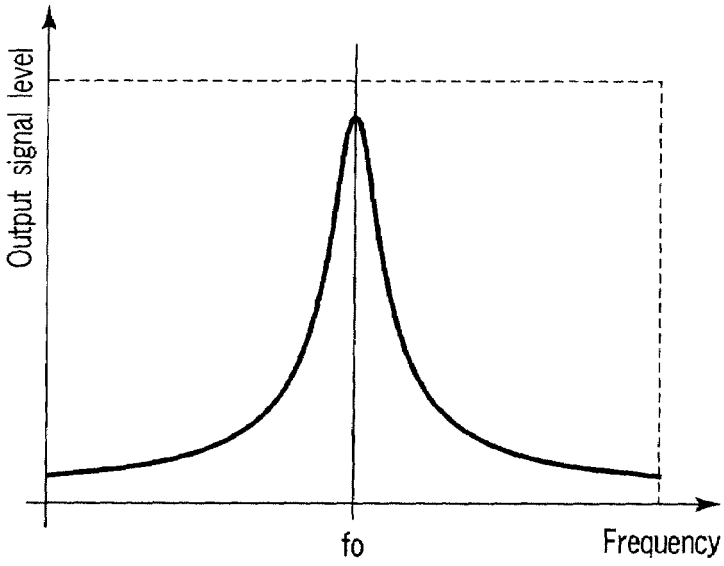
FIG. 17 is a view showing a frequency response of the resonator in FIGS. 16A and 16B.

The input line 303 and output line 304 (also called exciting line) extend up to edge portions of the substrate 300 and form an input/output feed to be connected to another electronic circuit, for example, a network analyzer at the edge portions of the substrate 300. When an input signal is input from the input line 303, the output line 304 outputs a signal based on the resonant property of the resonator 305, for example, shown in FIG. 17. FIG. 17 shows an example in the case where a resonant frequency $f_0$ is 7.025 GHz.

Figure 18:
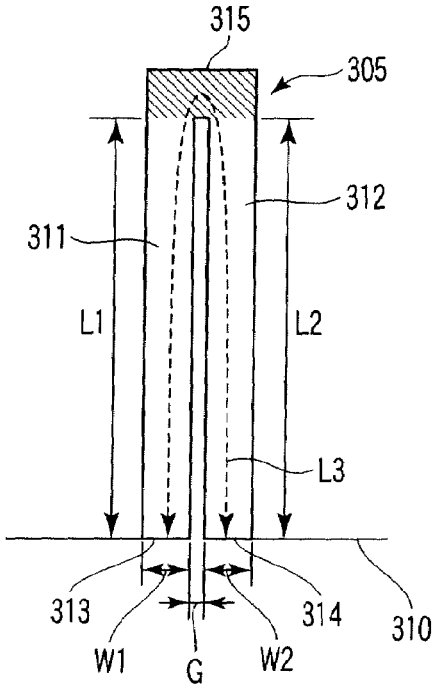
FIG. 18 is a view explaining a resonator pattern of resonators in FIGS. 16A and 16B.

The resonator patterns 305 in FIGS. 16A and 16B have, as shown in FIG. 18, two straight transmission lines 311 and 312 (first and second lines) and a connection line 315 (third line). Each length L1 and L2 of the transmission line 311 and 312 is approximately equal to each other. And each line width W1 and W2 is also approximately equal to each other. The transmission lines 311 and 312 are arranged in parallel with each other, and have a first open end portion 313 and a second open end portion 314, respectively, which are roughly positioned on the same line 310. A distance G between the transmission line 311 and 312 is smaller than each line width W1 and W2. On the other hand, the opposite end portions to the open end portions 313 and 314 of the corresponding transmission lines 311 and 312 are connected with each other through the connection line 315. Further, a total electrical length L3 of the transmission lines 311 and 312 and the connection line 315 to be an electrical length of a resonator (electrical length from the first open end portion 313 up to the second open end portion 314 via the transmission lines 311 and 312 and connection line 315, and hereinafter, referred to shortly as electrical length of resonator) is roughly an odd number, three or more, multiple of 180°.

Figure 19:
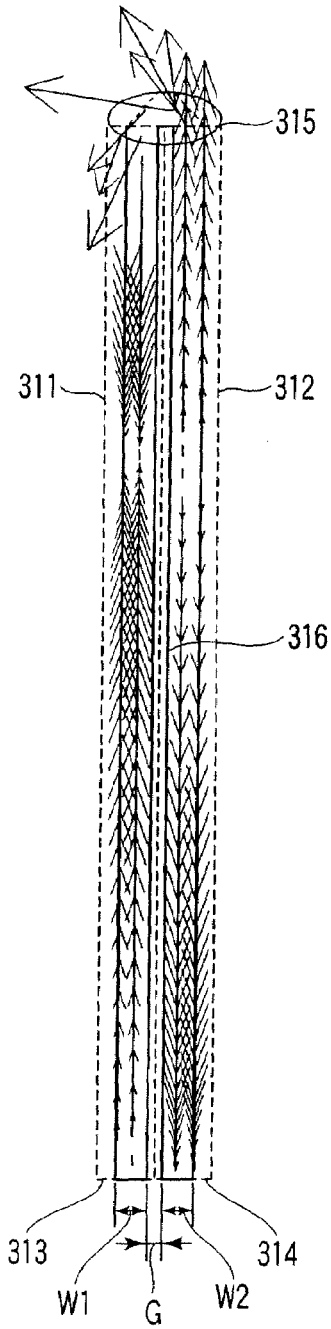
FIG. 19 is a view showing a current distribution in the case where electrical lengths L3 of the resonators in FIGS. 16A and 16B are 540° (triple of 180°)

The resonator pattern 305 in this embodiment has a steep resonant property with high Q in comparison to a conventional resonator, because the radiation loss is suppressed. Hereinafter, this reason will be explained. FIG. 19 shows by arrows a current distribution in the case in which the electrical length L3 of resonator is 540° (triple of 180°). Directions of arrows indicate directions of currents and lengths of the arrows indicate magnitude of the currents.

As is clear from FIG. 19, directions of currents in one straight transmission line 311 and directions of currents in the other straight transmission line 312 are roughly reverse to one another, and magnitude of the currents are equal to one another. Current distributions are concentrated to an inner edge 316 of the resonator pattern 305. When the transmission lines 311 and 312 in which reversed currents flow, respectively, come close to each other, since magnetic fields generated from the transmission lines 311 and 312 cancel each other, external radiation of electromagnetic fields from the resonator is suppressed, then, the suppression decreases radiation losses of the resonator. Furthermore, since the distance G between two straight transmission lines 311 and 312 (distance between open end portions 313 and 314) is smaller than each line width W1 and W2, the resonator pattern 305 further enhances the reduction effect of the radiation losses. Accordingly, this embodiment can realize a resonator having high Q.

Figure 20:
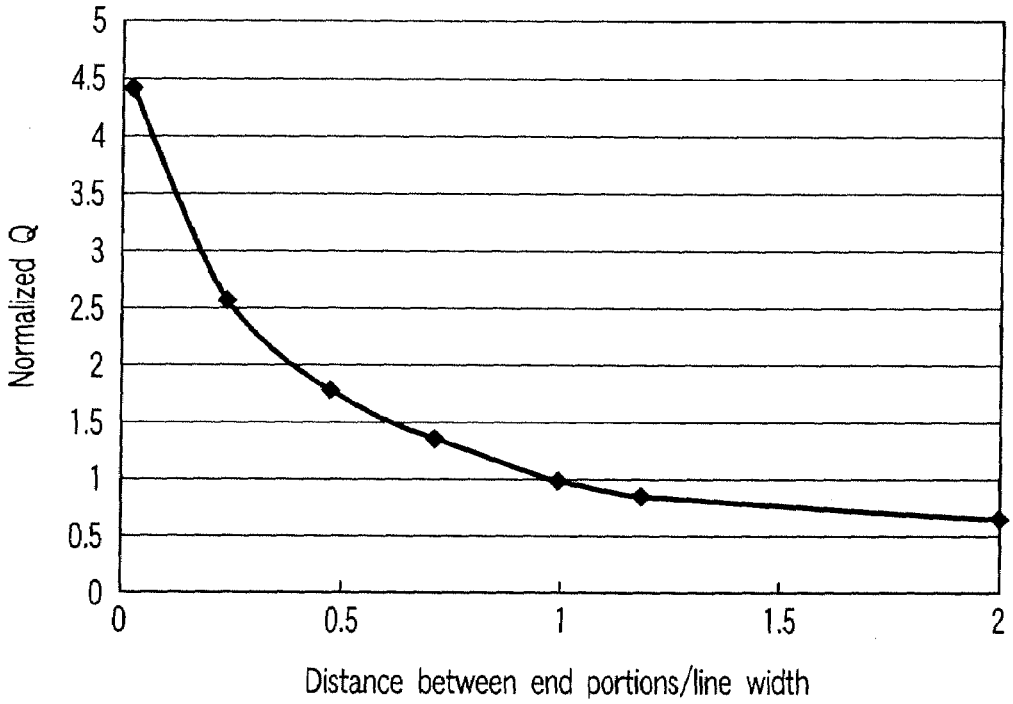
FIG. 20 is a view showing a result of a calculation of variations in Q of resonators in the case where electric lengths L3 of the resonators in FIGS. 16A and 16B are varied against line widths W1 and W2, by means of an electromagnetic analysis.

FIG. 20 shows a graphic chart showing a result of a calculation of variations in Q of a resonator by means of the electromagnetic analysis, when the distance G between open end portions is varied against the line widths W1 and W2. A horizontal axis indicates a ratio of the distance G to the line widths W1 and W2 and a vertical axis indicates normalized Q by setting the Q when the line width W1 and W2 is each equal to the distance G to '1'. The calculation has performed by using the resonator with a resonant frequency $f_0$: $f_0$=7.025 GHz and with both line widths W1 and W2: W1=W2 =0.42 mm shown in FIG. 17.

As is cleared from FIG. 20, the Q increases as the distance G between open end portions becomes smaller, and also the Q increases rapidly when the distance G becomes smaller than the line widths W1 and W2. Therefore, making the distance G smaller than at least the line widths W1 and W2 brings an remarkable effect on a restriction of a radiation loss to achieve a resonator with high Q.

Figure 21A:
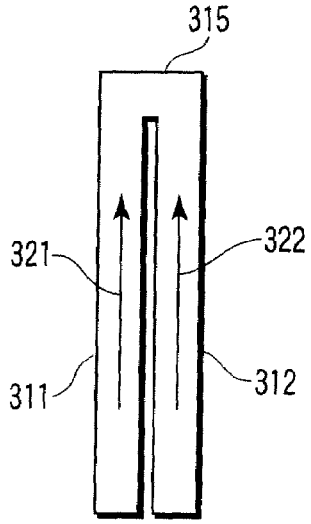
FIGS. 21A and 21B are views schematically showing current distributions in the cases where the electrical lengths L3 of the resonators in FIGS. 16A and 16B are twice of 180° (360°) and triple of 180° (540°)
Figure 21B:
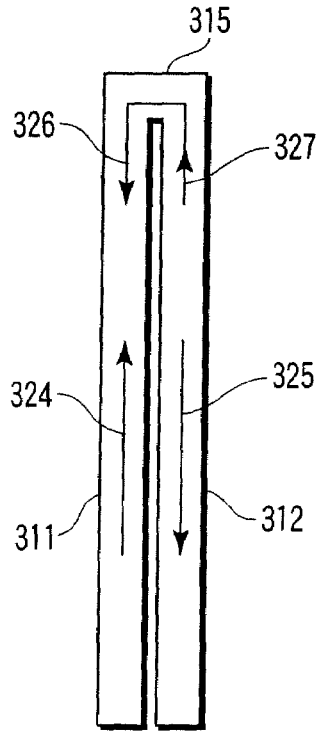

In the hairpin resonator, it is necessary to make the electrical length L3 of the resonator be nearly an odd number multiple of 180° in order to produce a radiation restriction effect owing to the above-mentioned adjacent and reversed currents. FIGS. 21A and 21B schematically show the current distributions in the cases where the electrical lengths L3 of the resonators in FIGS. 16A and 16B are twice of 180° (360°) and triple of 180° (540°), respectively.

In the case that the electrical length L3 of the resonator is an even number multiple of 180°, as shown in FIG. 21A, since directions of currents 321 and 322 in the transmission lines 311 and 312 are the same with each other, they have no effect on cancellations of magnetic fields and cannot suppress radiation losses. In contrast, in the case that the electric length L3 of the resonator is an odd number, three or more, multiple of 180°, as shown in FIG. 21B, since the directions of the currents in the transmission lines 311 and 312 are reversed at portions (324 and 325) far from the connection line 315 and also reversed even at positions (326 and 327) near by the connection line 315, they have effect on the cancellations of the magnetic fields and can suppress the radiation losses.

In the case that the electrical length L3 of the resonator is an odd number multiple of 180°, furthermore, the resonator can enhance the Q thereof as the electrical length L3 becomes longer. The Q-value is a ratio of an energy stored in the resonator to the loss thereof, the stored energy is roughly proportional to the number of antinodes of current standing waves in the resonator and it increases as the electrical length L3 becomes longer. On the other hand, taking losses into account brings the fact that the radiation loss is dominant to the conductor loss into the open. The radiation loss comes from the magnetic field which has not been completely cancelled by the reversed currents. As shown in FIG. 21B, the magnetic field which has not been completely cancelled comes from the currents in the connection line 315 in which the adjacent and reversed currents do not exist. Making the electrical length L3 of the resonator be triple of 180° causes an increase in the number of antinodes on the current standing waves by 2, in comparison with the case in which the electrical length L3 of the resonator is 180°. Here, since the increased two antinodes of the current standing waves are close to and inversed parallel with each other and cancel mutual magnetic fields substantially completely, the radiation losses do not increase. Accordingly, the stored energy increase and the losses do not vary substantially, so that the Q-value of the resonator increases.

Figure 22:
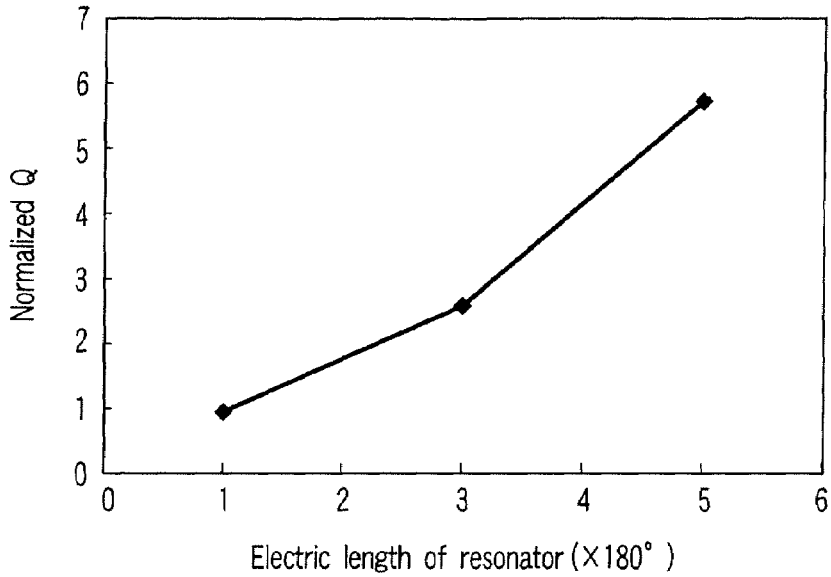
FIG. 22 is a view showing a result of a calculation of variations in Q resulting from the electrical lengths L3 of the resonators in FIG. 16A and 16B, by means of an electromagnetic field simulation.

FIG. 22 shows the result of the calculation of variations in Q resulting from the electrical lengths L3 of the resonator, by means of the electromagnetic analysis. In FIG. 22, a horizontal axis indicates the length L3 of the resonator by a multiple number of 180°, and a vertical axis indicates a normalized Q by setting the case where the length L3 is 180° to "1". As is clear form FIG. 22, the Q of the resonator becomes large in accordance with the increase in length of the electrical length L3 of the resonator.

The increase of the Q owing to the suppression of the radiation losses on the basis of the above-described embodiments of the present invention is specifically effective in the case where the conductor losses of the resonators are small and the radiation losses thereof are dominant. Therefore, it is further effective in the case of using a superconductor as a conductor material for the resonator layout 305.

Figure 23A:
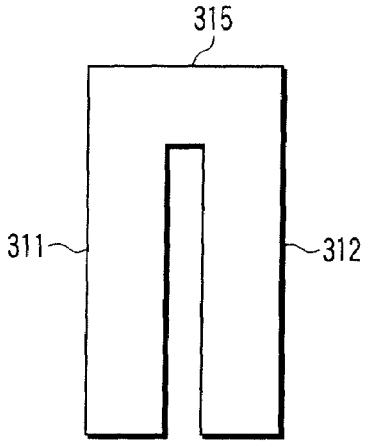
FIGS. 23A to 23F are plane views showing a variety of examples of resonator patters.

As the resonator pattern 305, such a variety of layouts shown in FIGS. 23A to 23F can be used. FIG. 23A shows the layouts 305 shown in FIG. 16A, 16B and 18 and FIGS. 23B-23F each show the modified layout shown in FIG. 23A.

Figure 23B:
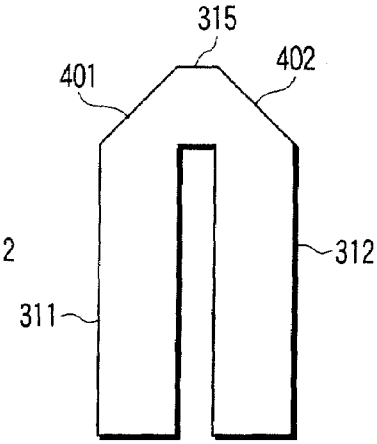
Figure 23C:
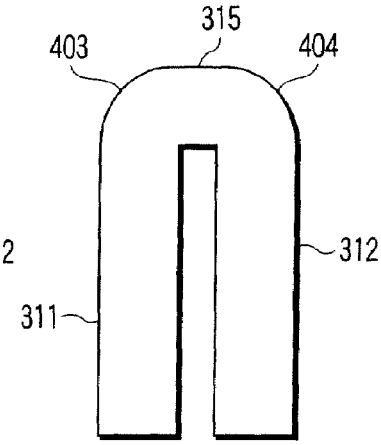
Figure 23D:
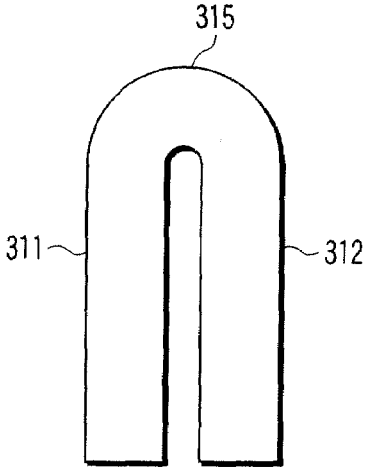

FIG. 23B shows a layout in which corners 401 and 402 of the connection line 315 are straightly cut off. For reducing the conductor losses so as to enhance the Q of the resonator, it is desirable to uniform a current density distribution in lines of the resonator layout as much as possible then it is preferable not to exist any folding portion in the lines. In the case that the existence of the folding portions is, however, needed because the circuit should be miniaturized, it is preferable to decrease influence of folding by removing the corners 401 and 402 of the folding portions, as shown in FIG. 23B, in order to match impedance between the straight lines 311, 312 and the connection line 315. FIG. 23C shows a modification of the layout in FIG. 23B, in which corners 403 and 404 of the connection line 315 are cut off into arc shapes, respectively. FIG. 23D shows a layout to make the connection line 315 be an arc shape.

Figure 23E:
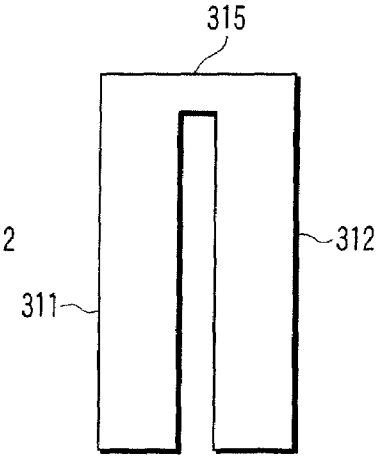
Figure 23F:
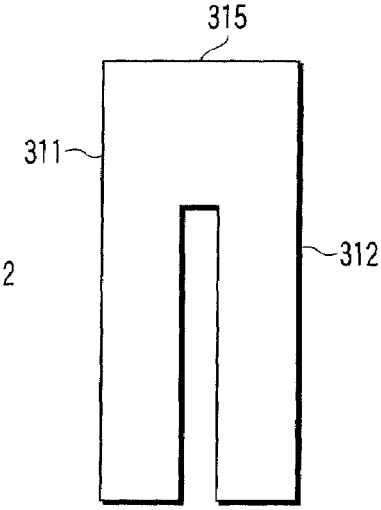

FIG. 23E shows a resonator layout to make the line width of the connection line 315 be narrower than those of two straight transmission lines. FIG. 23F shows a resonator layout to make the line width of the connection line 315 be wider than those of the straight lines 311 and 312.

Furthermore, a resonator layout may be a new layout to make the straight lines 311 and 312 slightly differ in length and line width. Thereby, when achieving a filter like a band-pass filter by using resonators, the resonant frequencies of a resonator and the coupling factor between resonators can be finely adjusted by adjusting the lengths and line widths of the resonators.

Figure 24:
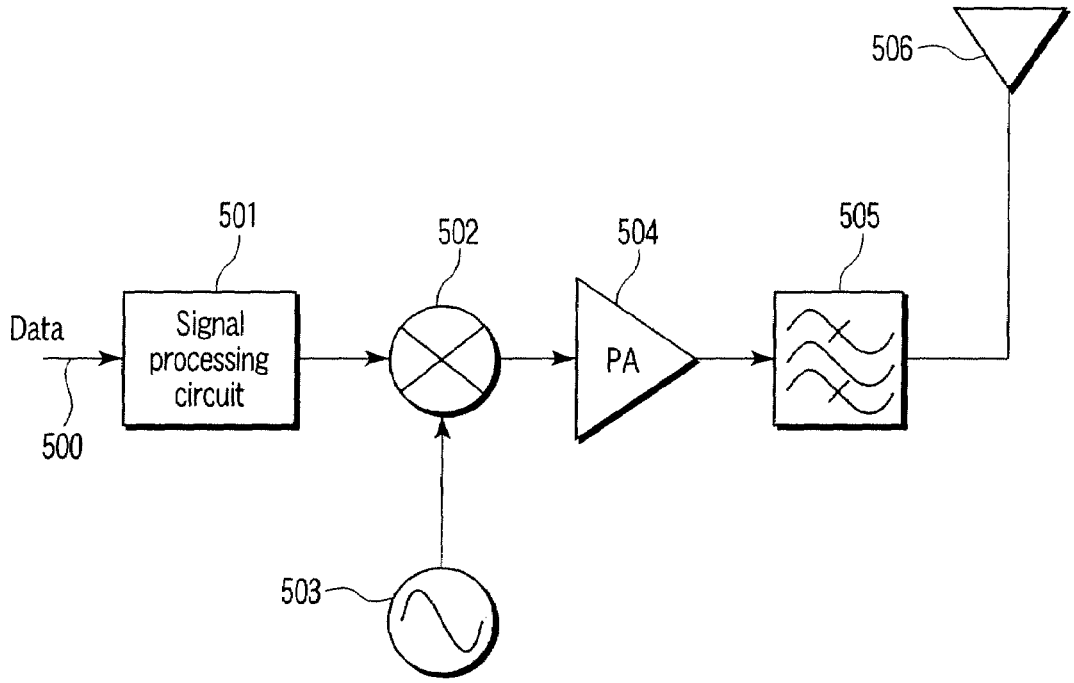
FIG. 24 is a block diagram showing an example of a transmitting unit of a radio communication device using a filter regarding an embodiment of the present invention.

Successively, examples to apply the filters to the radio communication devices, respectively, will be described by referring to FIG. 24 and FIG. 25. FIG. 24 schematically shows a transmitting unit of the radio communication device. Data 500 to be transmitted is input to a signal processing circuit 501 to be performed a digital-analog conversion, encoding, modulation and the like, then, a transmission signal in a base band or intermediate frequency band is generated. The transmission signal from the signal processing circuit 501 is input to a frequency converter (mixer) 502 to be multiplied by a local signal from a local signal generator 503, and then it is frequency-converted, namely up-converted into a signal in a radio frequency (RF) band.

A power amplifier 504 amplifies the RF signal output from the mixer 502 to input it to a band limiting filter (transmitting filter) 505. The band limiting filter 505 limits the band of the RF signal to remove unnecessary frequency components then supplies it to an antenna 506. Here, the filters described above are usable for the band limiting filter 505.

Figure 25:
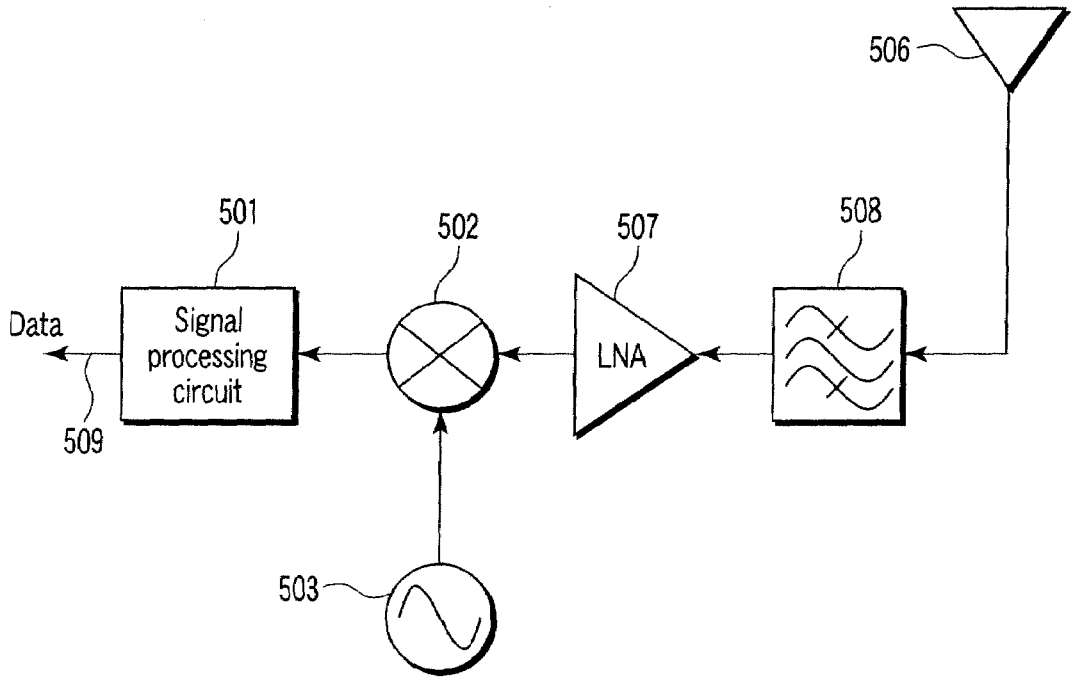
FIG. 25 is a block diagram showing an example of a receiving unit of the radio communication device using the filter regarding an embodiment of the present invention.

FIG. 25 schematically shows a receiving unit of the radio communication device. A signal received at the antenna 506 is input to a band limiting filter (receiving filter) 508 to be limited its band. Then, unnecessary frequency components of the received signal are removed to be input to a low-noise amplifier 507. The amplifier 507 amplifies the signal and inputs it in the mixer 502 to multiply it by the local signal and convert it into a signal in the base band or of an intermediate frequency. The signal converted into one with a low frequency is input to the signal processing circuit 501 to be demodulated then reception data 509 is output. In this case, the filters mentioned above in the foregoing embodiments are usable for the band limiting filter 508.

The present invention can minimize a disturbance in a current distribution generating a radiation of a resonator and can bring the current distribution as close to a distribution of an original microstrip line which does not generate any radiation. Thereby, even when conductors approximate to each other to make an inter-resonator coupling, the present invention can suppress deterioration in Q resulting from the radiation and realize a filter having a steep skirt property.

Further, according to the present invention, the radiation losses of a resonator can be effectively suppressed by making a distance between two straight transmission lines of the resonator be narrower than the line widths thereof and by setting the electrical length of the resonator to approximately the odd number, three or more, multiple of 180°. Accordingly, even in a high-frequency band of, for example, 3 or more GHz, in which the radiation losses are dominant, resonators having high Q can be provided.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A filter, comprising:

a resonant unit which has a plurality of resonators formed of microstrip lines and connected in cascade with one another; and a coupling unit which has a plurality of couplings of the resonant unit in an area within a range of ±45° (⅛-wavelength) in an electric length from voltage maximum points of the microstrip lines and at least one inter-resonator coupling of the resonant unit in an area within a range of ±45° (⅛-wavelength in an electric length from a voltage maximum point at an intermediate of the microstrip lines.

2. The filter according to claim 1, wherein the coupling unit includes coupling elements each arranged to face areas of the microstrip lines; and a connection line to connect between the coupling elements.

3. The filter according to claim 2, wherein lengths of the coupling elements are not smaller than a width of the connection line and electric lengths of the coupling elements are not larger than 90° (quarter-wavelength).

4. The filter according to claim 1, wherein at least another inter-resonator coupling of the resonant unit is formed by facing open end portions of the microstrip lines toward each other.

5. The filter according to claim 1, wherein the inter-resonator coupling is an inter-adjacent-resonator coupling or an inter-resonator cross coupling.

6. The filter according to claim 1, wherein each microstrip line of the resonant unit includes a first line and a second line which are arranged in nearly parallel with each other on a dielectric substrate and respectively have a first open end portion and a second open end portion adjacent to each other; and a third line which is arranged on the dielectric substrate and connects between a third end portion and a fourth end portion, the third end portion being an opposite end to the first open end portion of the first line and the fourth end portion being an opposite end to the second open end portion of the second line.

7. The filter according to claim 6, wherein the widths of the first line and the second line are substantially equal to each other, a distance between the first line and the second line is narrower than the line widths thereof, and a total electrical length of the first, second, and third lines is an odd number, that is three or more multiples of 180° (half-wavelength).

8. A filter, comprising:

an input line which receives an input signal;

an output line which outputs an output signal;

a resonant unit which has a plurality of resonators each formed of a microstrip line including a first resonator coupled to the input line, a second resonator connected to the output line and a plurality of third resonators positioned at intermediates between the first resonator and the second resonator and connected in cascade with one another;

a first coupling unit which has a coupling between the input line and the first resonator in a first area within a range of ±45° in an electric length from a voltage maximum point at an intermediate of the microstrip line of the first resonator;

a second coupling unit which has a coupling between the second resonator and the output line in a second area within a range of ±45° in electric lengths from a voltage maximum point at an intermediate of the microstrip line of the second resonator; and at least two third coupling units which have inter-resonator couplings of the third resonators in third areas within ranges of ±45° in electric lengths from voltage maximum points at intermediates of the microstrip lines of the third resonators.

9. The filter according to claim 8, wherein the first coupling unit has a first coupling element which is connected to the input line and faces the first area.

10. The filter according to claim 8, wherein the second coupling unit has a second coupling element which is connected to the output line and faces the second area.

11. The filter according to claim 8, wherein the at least two third coupling units have a pair of coupling elements which are arranged opposite to the third areas, respectively, and connection lines which connect the pair of coupling elements.

12. The filter according to claim 8, wherein each microstrip line of the resonant unit includes a first line and a second line which are arranged in nearly parallel with each other on a dielectric substrate and respectively have a first open end portion and a second open end portion adjacent to each other; and a third line which is arranged on the dielectric substrate and connects a third end portion and a fourth end portion, the third end portion being an opposite end to the first open end portion of the first line, and the fourth end portion being an opposite end to the second open end portion of the second line.

13. The filter according to claim 12, wherein the third line is arranged on the dielectric substrate and connects between the third end portion and the fourth end portion, each width of the first line and the second line being substantially equal to each other, a distance between the first line and the second line being narrower than the line widths thereof and a total electrical length of the first, second and third lines being an odd number, that is three or more multiples of 180° (half-wavelength).

14. A radio communication device, comprising:

a power amplifier which amplifies a radio frequency signal;

the filter of claim 1, wherein the filter receives an output signal from the power amplifier to limit a band; and an antenna which receives and transmits the output signal from the filter.

15. A radio communication device, comprising:

an antenna which receives a radio frequency signal;

the filter of claim 1, wherein the filter receives an output signal from the antenna to limit a band; and a low-noise amplifier which receives and amplifies an output signal from the filter.

* * * * *